US005195939A

United States Patent [19]

Gingras

[11] Patent Number: 5,195,939

[45] Date of Patent: Mar. 23, 1993

[54] THREE PHASE CENTRIFUGAL SEPARATOR

[76] Inventor: Earl Gingras, Box 542, Valleyview, Alberta, Canada, T0H 3N0

[21] Appl. No.: 838,570

[22] Filed: Feb. 19, 1992

[30] Foreign Application Priority Data

Sep. 9, 1991 [CA] Canada ..... 2050981

[51] Int. Cl.[5] ..... B04B 7/02

[52] U.S. Cl. ..... 494/60; 55/467; 494/900; 494/901

[58] Field of Search ..... 494/43, 44, 56, 85, 494/900, 901, 31, 32, 34, 60, 35, 42; 210/781; 55/345, 347, 406, 467

[56] References Cited

U.S. PATENT DOCUMENTS

| | | | |
|---|---|---|---|
| 2,234,921 | 3/1941 | Webb | 261/83 |
| 2,244,034 | 6/1941 | Van Riel | 233/14 |
| 2,283,457 | 5/1942 | Pecker | 210/69 |
| 2,578,485 | 12/1951 | Nyrop | 233/15 |
| 3,559,879 | 2/1971 | Bechard | 233/1 |
| 3,791,575 | 2/1974 | Kartinen et al. | 233/19 |
| 3,810,347 | 5/1974 | Kartinen | 55/45 |
| 3,844,738 | 10/1974 | Reinhoudt et al. | 55/36 |
| 3,960,319 | 6/1976 | Brown et al. | 233/19 |
| 4,044,943 | 8/1977 | Brown et al. | 233/19 |
| 4,108,354 | 8/1978 | Madsen | 494/43 |
| 4,190,194 | 2/1980 | Amero | 233/7 |
| 4,283,005 | 8/1981 | Erickson | 233/47 |
| 4,362,620 | 12/1982 | High | 210/378 |
| 4,617,010 | 10/1986 | Epper et al. | 494/52 |
| 4,626,237 | 12/1986 | Galloway | 494/44 |

FOREIGN PATENT DOCUMENTS

| | | | |
|---|---|---|---|
| 728533 | 2/1966 | Canada | 233/16 |
| 2317001 | 11/1973 | Fed. Rep. of Germany . | |

*Primary Examiner*—Robert W. Jenkins

*Attorney, Agent, or Firm*—David, Bujold & Streck

[57] ABSTRACT

A three phase centrifugal separator for separating the components of a fluid mixture of oil, water and gas, consisting of a cylindrical drum rotatably mounted within a pressure vessel. Two liquid phase holding tanks connected to the pressure vessel are also maintained under pressure. The drum has an initial separation chamber which separates gaseous phase fluids from liquid phase fluids. Water is forced to the outer circumference of the drum by centrifugal force and forms a water zone within the confines of a first and a second annular weirs. The first annular weir is lower than the second annular weir such that water is retained in the water zone until the level of the first annular weir is attached, thereafter any additional water entering the water zone results in a migration of water between the drum and the first annular weir to a water phase outlet. Oil is forced into a water/oil interface on top of the water zone by centrifugal force. An oil passage is provided between the second annular weir and the second end of the drum. The second annular weir serves as a spillway whereby oil passes over the second annular weir to the oil passage leading to an oil phase outlet. Peripheral gas passages are provided at the second end of the drum. Gas flows from the primary separation chamber of the drum via the gas passages to a gas phase outlet.

7 Claims, 1 Drawing Sheet

THREE PHASE CENTRIFUGAL SEPARATOR

The present invention relates to a three phase centrifugal separator for a fluid mixture of oil, water and gas.

BACKGROUND OF THE INVENTION

Centrifugal separators work on the principle of differing densities of fluids. Of the three components, oil, water and gas, gas is the most difficult to separate, due to the fact that gas becomes entrained in the liquid constituents of the fluid mixture, and it takes time for the gas to be released. For this reason many centrifugal separators restrict their operation to two phase separation; permitting the gas to exit the centrifugal separator in the water or oil stream.

Centrifugal separators are susceptible to pressure fluctuations. A fluid mixture with a significant amount of entrained gases can cause a number of problems. One problem disclosed by Kartinen in U.S. Pat. No. 3,810,347 is that of the gas releasing in the flow paths of the separator and building up a back pressure which offers resistance to the flow of fluids through the separator. Another problem disclosed by Brown and Erickson in U.S. Pat. No. 4,044,943 is that of a fluctuation in the relative amounts of the oil, water, and gas phases, leading to an intermixing of the separation phases as evidenced by gas exiting through the outlet intended for water or oil.

The inability of the centrifugal separators to operate under pressure creates practical problems. In order to connect a centrifugal separator to an operating pipeline some line pressure is required. As the line pressure adversely affects the operation of existing centrifugal separators they cannot be connected to pipelines.

SUMMARY OF THE INVENTION

What is required is a centrifugal separator which is less susceptible to pressure fluctuations whether caused by the release of entrained gases or by line pressure.

According to the present invention there is provided a three phase centrifugal separator for separating the components of a fluid mixture of oil, water and gas, which is comprised of a pressure vessel having a first end, a second end, an internal cavity, a primary inlet and a water phase outlet, an oil phase outlet, and a gas phase outlet. A cylindrical drum is rotatably mounted within the interior cavity of the pressure vessel. The drum has an inlet which is axially aligned with the primary inlet of the pressure vessel. The inlet is enclosed by an initial separation chamber having a central gas passage and peripheral liquid passages. A partition is positioned transversely across the central gas passage such that a fluid mixture entering the initial separation chamber strikes the partition, with gaseous phase fluids flowing around the edges of the partition to enter a primary separation chamber via the central gas passage, and liquid phase fluids being directed by centrifugal force to the peripheral liquid passages whereby the liquid phase fluids enter the primary separation chamber. A first annular weir is secured to a peripheral exterior edge of the drum and spaced from a second annular weir formed within the primary separation chamber of the drum. A fluid port extends through the peripheral exterior edge of the drum such that water forced to the outer circumference of the drum by centrifugal force forms a water zone within the confines of the annular weirs. The first annular weir is lower than the second annular weir such that water is retained in the water zone until the level of the first annular weir is attained, thereafter any additional water entering the water zone results in a migration of water between the drum and the first annular weir to the water liquid phase outlet of the pressure vessel. Oil is forced into a water/oil interface on top of the water zone by centrifugal force. An oil passage is provided between the second annular weir and the second end of the drum. The second annular weir serves as a spillway whereby oil passes over the second annular weir to the oil passage leading to the oil phase outlet of the pressure vessel. Peripheral gas passages are provided at the second end of the drum. Gas flows from the primary separation chamber of the drum via the gas passages to the gas phase outlet of the pressure vessel. A control valve is positioned in the gas phase outlet to maintain the pressure vessel at a predetermined pressure level. Gas is released from the gas phase outlet as required to maintain the pressure vessel at the predetermined pressure level. A seal is provided between the cylindrical drum and the interior cavity of the pressure vessel whereby separation of the water phase outlet and the oil phase outlet is maintained.

The three phase separator as described is designed an a pressure vessel and as such is intended to operate under pressure. The pressure maintained in the pressure vessel is predetermined by the amount of pressure required to work with pressurized gas flow lines connected to the gas phase outlet. An initial separation of gas phase fluids and liquid phase fluids takes place in the initial separation chamber. Thereafter, entrained gases released by the water or the oil are retained within the primary separation chamber common to all three phase fluids. When the gas pressure in the pressure vessel exceeds the predetermined level, the excess gas is released into gas flow lines via the control valve on the gas phase outlet.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
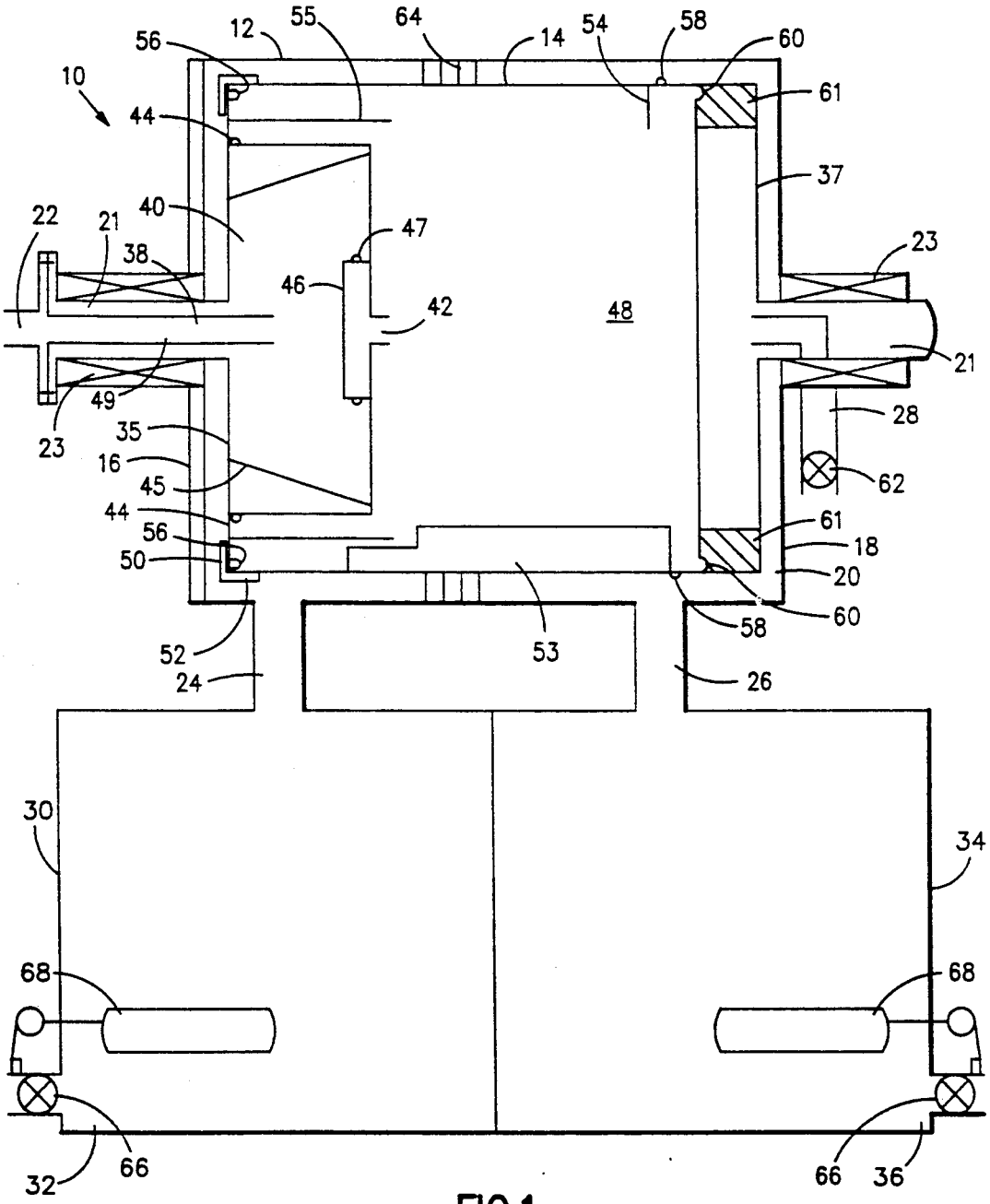
FIGURE 1 is a section view of a three phase centrifugal separator constructed in accordance with the teachings of the present invention.

The preferred embodiment, a three phase centrifugal separator generally identified by reference numeral 10, will now be described with reference to FIGURE 1.

Three phase centrifugal separator 10 is intended for use in separating the components of a fluid mixture of oil, water and gas. The primary components of three phase centrifugal separator 10 are a pressure vessel 12 and a cylindrical drum 14. Pressure vessel 12 has a first end 16, a second end 18, an internal cavity 20, a primary inlet 22, a water phase outlet 24, an oil phase outlet 26, and a gas phase outlet 28. In order to maintain pressure levels in pressure vessel 12, three phase centrifugal separator 10 must operate as a "closed system". For this reason it is preferred that water phase outlet 24 and oil phase outlet 26 be connected to holding tanks as is illustrated in FIGURE 1. A first holding tank 30 is adjacent first end 16 of pressure vessel 12. First holding tank 30 is connected to water phase outlet 24 of pressure vessel 12 such that the pressure in first holding tank 30 is equal to the pressure in pressure vessel 12. First holding tank 30 has a first outlet 32 whereby water can be removed. A second holding tank 34 is adjacent second end 18 of pressure vessel 12. Second holding tank is connected to oil phase outlet 26 of pressure vessel 12 such that the pressure in second holding tank 34 is equal to the pressure in pressure vessel 12. Second holding tank 34 has a second outlet 36 whereby oil can be removed. Cylindrical drum 14 is rotatably mounted within interior cavity 20 of pressure vessel 12. Drum 14 has a first end 35., a second end 37 and an inlet 38. The means of rotatably mounting cylindrical drum 14 are shafts 21 which extend outwardly from both first end 35 and second end 37 of drum 14. Shafts 21 are rotatably supported by bearings 23. Inlet 38 is axially aligned with primary inlet 22 of pressure vessel 12. Inlet 38 is enclosed by an initial separation chamber 40 having a central gas passage 42 and peripheral liquid passages 44. A first partition 46 is positioned transversely across central gas passage 42. A plurality of openings 47 are provided to enable gas phase fluids to flow around partition 46 into central gas passage 42. A plurality of angular spin vanes 45 are also positioned in initial separation chamber 40. A tube 49 extends from primary inlet 22 of pressure vessel 12 into initial separation chamber 40 thereby directing fluids at partition 46. Cylindrical drum 14 also has a primary separation chamber 48. A second partition 55 extends from first end 35 of drum 14 into primary separation chamber 48 immediately adjacent peripheral liquid passages 44. A first annular weir 50 is secured to a peripheral exterior edge 52 at first end 35 of drum 14 and spaced from a second annular weir 54 formed within primary separation chamber 48 of drum 14. a plurality of spin vanes 53 are positioned between first annular weir 50 and second annular weir 54 in primary separation chamber 48. A fluid port 56 extends through first end 35 of drum 14, thereby enabling fluids to flow between second annular weir 54 and first annular weir 50. First annular weir 50 is lower than second annular weir 54 by a fraction of an inch. An oil passage 58 is provided between second annular weir 54 and second end 37 of drum 14. Peripheral gas passages 60 are provided at second end 37 of drum 14, which communicate with gas phase outlet 28. A demister pad 61 is positioned in the flow path of peripheral gas passages 60. A control valve 62 is positioned in gas phase outlet 28 to maintain pressure vessel 12 at a predetermined pressure level. A labyrinth type seal 64 is provided between cylindrical drum 14 and interior cavity 20 of pressure vessel 12, whereby separation of water phase outlet 24 and oil phase outlet 26 is maintained. First outlet 32 of first holding tank 30 and second outlet 36 of second holding tank 34 have valves 66 which are activated by floats 68.

The use and operation of three phase centrifugal separator 10 will now be described with reference to FIGURE 1. Three phase centrifugal separator 10 is activated in order to commence the rapid rotation of cylindrical drum 14. Water is initially fed into primary inlet 22 for the purpose of "priming" three phase centrifugal separator by filling the water zone between first annular weir 50 and second annular weir 54. Fluid mixtures of water, oil and gases are then directed into pressure vessel 12. Fluid mixtures enter pressure vessel through primary inlet 22 and pass through inlet 38 of cylindrical drum 14. As the fluid mixture enters initial separation chamber 40 it is directed by tube 49 onto partition 46. As the fluid mixture deflects off partition 46 it is thrown outwardly by centrifugal force, and agitated by angular spin vanes 45. The striking of partition 46 and agitation by spin vanes 45 causes the fluid mixture to release a portion of its entrained gases. Gaseous phase fluids flow around partition 46 and through peripheral openings 47 entering primary separation chamber 48 via central gas passage 42. Liquid phase fluids thrown outwardly by centrifugal force pass through peripheral liquid passages 44 into primary separation chamber 48. In the primary separation chamber 48 a separation of the oil and water components of the liquid phase fluids takes place. The liquid fluid mixture passes along second partition 55. Water is forced to the outer circumference of drum 14 by centrifugal force and forms a water zone within the confines of first annular weir 50 and second annular weir 54. As first annular weir 50 is lower than second annular weir 54 by a fraction of an inch water is retained in the water zone until the level of first annular weir is reached. The spin vanes 53 positioned within the water zone ensure the water in the water zone moves at the same rotational speed as drum 14. As additional water enters the water zone, water migrates through fluid port 56 and then passes between first annular weir 50 and first end 35 of drum 14 into interior cavity 20 of pressure vessel 12. Once within pressure vessel 12 the water flows by force of gravity through water phase outlet 24 and into first holding tank 30. Second partition 55 assists in maintaining a separation between liquid phase fluids that have not as yet separated into their constituent components of water and oil, and water exiting through fluid port 56. Oil is forced into a water/oil interface on top of the water zone by centrifugal force. As a layer of oil builds up on water within the water zone, second annular weir 54 serves as a spillway whereby oil passes over second annular weir 54 and migrates by centrifugal force to oil passage 58 leading to interior cavity 20 of pressure vessel 12 and to oil phase outlet 26. Oil then flows from oil phase outlet 26 by force of gravity to second holding tank 34. Further gases are released by the liquid phase fluid mixture as it divides into its constituent elements of oil and water. If there exited a pressure differential in either first holding tank 30 or second holding tank 34 there would be a propensity for the gas to follow the liquids into these tanks. However, as the holding tanks are maintained under equal pressure as a closed system as gas is released it remains in primary separation chamber 48. Gas flows from primary separation chamber 48 of drum 14 via gas passages 60 to gas phase outlet 28 of pressure vessel 12. The positioning of demister pads 61 in the flow path for the gas, serves to retard the entry of liquid phase fluids, in particular oil, without adversely affecting Gas flow. Control valve 62 is used to release gas from gas phase outlet 28 as may be required to maintain pressure vessel 12 at a predetermined pressure level. Until an equalization of pressure takes place between first holding tank 30, second holding tank 34 and pressure vessel 12 some gas unavoidably enters first holding tank 30 and second holding tank 34. This gas serves a function in pressuring up the system, but is not intended to be allowed to pass through first outlet 32 or second outlet 36. Float actuated valves 66 ensure that liquid can only be drawn from outlets 32 or 35 when the level of liquid exceeds a predetermined level governed by float 68. This liquid is drawn from the lower portion of first holding tank 30 and second holding tank 34. Any gases pressurizing first holding tank 30 and second holding tank 34 are retained.

It will be apparent to one skilled in the art that the operation of three phase centrifugal separator 10 as described is not adversely effected by entrained gases. It will also be apparent to one skilled in the art that fluctuations in the constituent elements of the fluid mixture entering pressure vessel 12 does not adversely effect operations. It will finally be apparent to one skilled in the art that modifications may be made to the illustrated embodiment without departing from the spirit and scope of the invention as defined by the claims.

The embodiments of the invention in which an exclusive property or privilege is claimed are defined as follows:

1. A three phase centrifugal separator for separating the components of a fluid mixture of oil, water and gas, comprising:

a. a pressure vessel having a first end, a second end, an internal cavity, a primary inlet and a water phase outlet, an oil phase outlet, and a gas phase outlet;

b. a cylindrical drum rotatably mounted within the interior cavity of the pressure vessel, the drum having an inlet which is axially aligned with the primary inlet of the pressure vessel, the inlet being enclosed by an initial separation chamber having a central gas passage and peripheral liquid passages, a partition being positioned transversely across the central gas passage such that a fluid mixture entering the initial separation chamber strikes the partition, with gaseous phase fluids flowing around the edges of the partition to enter a primary separation chamber via the central gas passage, and liquid phase fluids being directed by centrifugal force to the peripheral liquid passages whereby the liquid phase fluids enter the primary separation chamber, a first annular weir secured to a peripheral exterior edge of the drum and spaced from a second annular weir formed within the primary separation chamber of the drum, a fluid port extending through the peripheral exterior edge of the drum such that water forced to the outer circumference of the drum by centrifugal force forms a water zone within the confines of the annular weirs, the first annular weir being lower than the second annular weir such that water is retained in the water zone until the level of the first annular weir is attained, thereafter any additional water entering the water zone results in a migration of water between the drum and the first annular weir to the water phase outlet of the pressure vessel, oil being forced into a water/oil interface on top of the water zone by centrifugal force, an oil passage being provided between the second annular weir and the second end of the drum, the second annular weir serving as a spillway whereby oil passes over the second annular weir to the oil passage leading to the oil phase outlet of the pressure vessel, peripheral gas passages being provided at the second end of the drum, gas flowing from the primary separation chamber of the drum via the gas passages to the gas phase outlet of the pressure vessel;

c. a control valve being positioned in the gas phase outlet to maintain the pressure vessel at a predetermined pressure level, such that gas is released from the gas phase outlet as required to maintain the pressure vessel at the predetermined pressure level; and d. a seal between the cylindrical drum and the interior cavity of the pressure vessel whereby separation of the water phase outlet and the oil phase outlet is maintained.

2. The three phase separator as defined in claim 1, means being provided in the gas passages to retard the entry of liquid phase fluids.

3. The three phase centrifugal separator as defined in claim 1, a plurality of spin vanes being positioned within the circumferential water zone thereby ensuring the water moves at the same rotational speed as the drum.

4. The three phase centrifugal separator as defined in claim 1, a partition extending axially into the primary separation chamber to maintain separation of liquids phase fluids flowing from the liquid phase inlet of the initial separation chamber and water in the circumferential water zone of the primary separation chamber.

5. The three phase centrifugal separator as defined in claim 1, the initial separation chamber having a plurality of angular spin vanes.

6. A three phase centrifugal separator for separating the components of a fluid mixture of oil, water and gas, comprising:

a. a pressure vessel having a first end, a second end, an internal cavity, a primary inlet and a water phase outlet, an oil phase outlet, and a gas phase outlet;

b a first holding tank adjacent the first end of the pressure vessel, the first holding tank being connected to the water phase outlet of the pressure vessel such that the pressure in the first holding tank is equal to the pressure in the pressure vessel, the first holding tank having a first outlet whereby water can be removed;

c. a second holding tank adjacent the second end of the pressure vessel, the second holding tank being connected to the oil phase outlet of the pressure vessel such that the pressure in the second holding tank is equal to the pressure in the pressure vessel, the second holding tank having a second outlet whereby oil can be removed;

d. a cylindrical drum rotatably mounted within the interior cavity of the pressure vessel, the drum having an inlet which is axially aligned with the primary inlet of the pressure vessel, the inlet being enclosed by an initial separation chamber having a central gas passage and peripheral liquid passages, a partition being positioned transversely across the central gas passage such that a fluid mixture entering the initial separation chamber strikes the partition, with gaseous phase fluids flowing around the edges of the partition to enter a primary separation chamber via the central gas passage, and liquid phase fluids being directed by centrifugal force to the peripheral liquid passages whereby the liquid phase fluids enter the primary separation chamber, a first annular weir secured to a peripheral exterior edge of the drum and spaced from a second annular weir formed within the primary separation chamber of the drum, a fluid port extending through the peripheral exterior edge of the drum such that water forced to the outer circumference of the drum by centrifugal force forms a water zone within the confines of the annular weirs, the water zone being balanced such that water is retained in the water zone until a preset operating level is attained, thereafter any additional water entering the water zone results in a migration of water between the drum and the first annular weir to the water liquid phase outlet of the pressure vessel, oil being forced into a water/oil interface on top of the water zone by centrifugal force, an oil passage being provided between the second annular weir and the second end of the drum, the second annular weir serving as a spillway whereby oil passes over the second annular weir to the oil passage leading to the oil phase outlet of the pressure vessel, peripheral gas passages being provided at the second end of the drum, gas flowing from the primary separation chamber of the drum via the gas passages to the gas phase outlet of the pressure vessel;

e. a control valve being positioned in the gas phase outlet to maintain the pressure vessel at a predetermined pressure level, such that gas is released from the gas phase outlet as required to maintain the pressure vessel at the predetermined pressure level; and f. a seal between the cylindrical drum and the interior cavity of the pressure vessel whereby separation of the water phase outlet and the oil phase outlet is maintained.

7. The three phase centrifugal separator as defined in claim 6, the first outlet of the first holding tank and the second outlet of the second holding tank each having a float actuated valve such that liquid can only be drawn from the outlet when the level of liquid exceeds a predetermined level governed by the float.

* * * * *